US005081502A

United States Patent [19]

Mitsuya et al.

[11] Patent Number: 5,081,502

[45] Date of Patent: Jan. 14, 1992

[54] RADIANT HEAT FIXING APPARATUS

[75] Inventors: Teruaki Mitsuya, Katsuta; Takao Kumasaka, Takahagi, both of Japan

[73] Assignees: Hitachi, Ltd.; Hitachi Koki Co., Ltd., both of Tokyo, Japan

[21] Appl. No.: 217,855

[22] Filed: Jul. 12, 1988

[30] Foreign Application Priority Data

| | | | |
|---|---|---|---|
| Jul. 15, 1987 | [JP] | Japan | 62-174798 |
| Jul. 29, 1987 | [JP] | Japan | 62-187594 |
| Jul. 29, 1987 | [JP] | Japan | 62-187595 |
| Jul. 29, 1987 | [JP] | Japan | 62-187596 |

[51] Int. Cl.[5] ..... G03G 15/20

[52] U.S. Cl. ..... 355/285; 355/215; 355/309

[58] Field of Search ..... 355/285, 284, 288, 283, 355/286, 215, 212, 274, 288, 76, 315, 309, 298, 312

[56] References Cited

U.S. PATENT DOCUMENTS

| | | | |
|---|---|---|---|
| 3,716,018 | 2/1973 | Ohta | 355/283 X |
| 3,743,403 | 7/1973 | Sanza | 355/315 X |
| 3,883,292 | 5/1975 | Hamaker | 355/283 X |
| 4,023,894 | 5/1977 | Goel | 355/274 X |
| 4,108,547 | 8/1978 | Stemmle | 355/76 X |
| 4,118,178 | 10/1978 | Calvi | 355/206 X |
| 4,286,863 | 9/1981 | Cornwall | 355/295 |
| 4,429,984 | 2/1984 | Kiba et al. | 355/215 X |
| 4,435,067 | 3/1984 | Draai | 355/277 |
| 4,531,825 | 7/1985 | Miwa | 355/279 |
| 4,607,947 | 8/1986 | Ensing | 355/283 |
| 4,768,057 | 8/1988 | Kumada | 355/288 |

*Primary Examiner*—A. T. Grimley
*Assistant Examiner*—Thu Dang
*Attorney, Agent, or Firm*—Antonelli, Terry, Stout & Kraus

[57] ABSTRACT

A fixing apparatus comprises; a conveyor belt device for conveying a recording medium on which toner images are developed, having two non-perforated conveyor belts and a plurality of perforated conveyor belts arranged between the two non-perforated conveyor belts; a radiant heating device arranged above the conveyor belt device, for heating the recording medium situated on the conveyor belt means by a flash and for fusing and fixing the toner images on the recording medium; and a suction device arranged in an area that is directly illuminated by the flash from the radiant heating means, below the plurality of perforated conveyor belts, so as to be completely covered by the plurality of perforated belts; and further includes at least one of features of; a cleaning device arranged outside of the area that is directly illuminated by the flash from the radiant heating means, for eliminating foreign matters on outer surfaces of the plurality of perforated conveyor belts; a tension adjusting device arranged outside of the area that is directly illuminated by the flash from the radiant heating means, for adjusting tension force of each of the conveyor belts; a gathering device arranged inside of the area that is directly illuminated by the flash from the radiant heating device below the suction means, for gathering the foreign matters dropped from the recording medium; and the plurality of perforated conveyor belts each having a bright color.

9 Claims, 2 Drawing Sheets

RADIANT HEAT FIXING APPARATUS

BACKGROUND OF THE INVENTION

The present invention relates to a fixing apparatus for copying machines and facsimiles which use toner, and more particularly, it relates to a radiant heat fixing apparatus.

In a conventional copying machine facsimile which uses toner, a recording medium on which toner images are developed by electrostatic force is passed between heat rolls to fuse and fix the toner on the recording medium.

In such a fixing apparatus having heat rolls, when the recording medium comprises recording paper, since the recording paper was heated together with the toner in the fixing process, there arose a problem that the paper curled due to evaporation of moisture in the paper and/or the paper shrunk due to local evaporation of moisture in the paper. Further, there was also a problem that the toner adhered to the heat rolls, thus preventing further effective fixing operations. Further, since the heat rolls cannot be heated to a desired temperature immediately after they are energized, in use, the heat rolls must be maintained in the energized condition so that the toner image on the recording medium can be fixed at any time, this is apparently disadvantageous from the view-point of saving energy.

In order to resolve the above-mentioned disadvantages, a radiant heat fixing apparatus wherein the heating is effected by a flash of a xenon flash lamp has been proposed as disclosed in the Japanese Utility Model Laid-Open No. 52-86429. This conventional fixing apparatus comprises a heating device including a xenon flash lamp, and a plurality of conveyor belts extending through a flash illuminated portion from the heating device. A recording medium on which toner images are developed by electrostatic force is sent, by means of the conveyor belts, into the flash illuminated portion from the heating device, where the recording medium is heated by the flash of the heating device, thus fusing and fixing the toner on the recording medium.

In this conventional fixing apparatus, since only the toner on the recording paper is heated, there is no problem with curling and/or the shrinking of the recording paper. Of course, since heat rolls are not used, there is no problem regarding the adhesion of the toner onto the heat rolls. Further, since the xenon flash lamp can emit the flash at the same time it is energized, the lamp may be energized only when the recording paper to be fixed is in the illuminated portion of the xenon flash lamp, thus saving considerable energy.

However, in this conventional fixing apparatus, it is not considered that the conveyor belts are heated; thus, when the conveyor belts are heated by repeated fixing operations to a temperature greater than the temperature that deforms the recording medium, the latter may be unfavorably curled or shrunk; and, in the worst case, the temperature of the conveyor belts will exceed a firing temperature of the recording medium, resulting in combustion of the latter.

Further, in the above-mentioned conventional fixing apparatus, no consideration is given to thermal expansion of the conveyor belts; thus, when the conveyor belts are heated by repeated fixing operations, there arises slack in the conveyor belt, which may cause the relative slipping or sliding movement between the conveyor belts, and driving rollers by which the belts are entrained, thus causing a problem with the transportation of the recording medium. Further, due to the slack in the conveyor belts, an illuminating angle of the flash with respect to the recording medium may be changed, thus causing a problem of imperfect fixing.

Furthermore, in the above-mentioned conventional fixing apparatus, since it is not considered that foreign matters may be adhered on an outer surfaces of the conveyor belts, if gas emitted from the heated toner adheres to on the outer surfaces of the conveyor belts as an impurity, there arises a problem that the impurity smears the back of the recording medium when it encounters the latter.

Lastly, in the above-mentioned conventional fixing apparatus, since it is also not considered that recording paper is used as the recording medium, there is a problem that paper powder from the recording paper which accumulates on the outer surfaces of the conveyor belts and fired by repeated heating to the belts and also that the paper powder drops through gaps between the conveyor belts to adhere on the back of the lower run of each conveyor belt, thus causing slipping movement of the belts, thereby creating a risk of imperfect transportation of the recording paper such as oblique motion of the paper, reduction of paper speed and the like.

SUMMARY OF THE INVENTION

Accordingly, an object of the present invention is to provide a radiant heat fixing apparatus which can prevent the deformation of the recording paper such as the curl and shrink, and the firing of the recording medium.

Another object of the present invention is to provide a radiant heat fixing apparatus which can prevent imperfect transportation of the recording medium and imperfect fixing of the toner.

A further object of the present invention is to provide a radiant heat fixing apparatus which can prevent the smearing of the recording medium and the firing of the paper powder.

A radiant heat fixing apparatus according to the present invention comprises conveyor belt means for conveying a recording medium on which toner images are developed, having two non-perforated conveyor belts and a plurality of perforated conveyor belts arranged between the two non-perforated conveyor belts, radiant heating means arranged above the conveyor belt means, for heating the recording medium situated on the conveyor belt means by a flash and for fusing and fixing the toner images on the recording medium, and suction means arranged in an area that is directly illuminated by the flash from the radiant heating means, below the plurality of perforated conveyor belts, so as to be completely covered by the plurality of perforated conveyor belts; and it further includes at least one of features of: cleaning means, arranged outside of the area that is directly illuminated by the flash from the radiant heating means, for eliminating foreign matters on outer surfaces of the plurality of perforated conveyor belts; tension adjusting means arranged outside of the area that is directly illuminated by the flash from the radiant heating means, for adjusting tension force of each of the conveyor belts; gathering means arranged inside of the area that is directly illuminated by the flash from the radiant heating means, below the suction means, for gathering the foreign matters dropped from the recording medium; and the plurality of perforated conveyor belts each having bright color.

Preferably, the radiant heating means includes a xenon flash lamp.

Further, preferably, the cleaning means is arranged in a position along a driving roller of the conveyor belt means.

In a preferred embodiment of the present invention, the cleaning means comprises a rotatable brush roller arranged in contact with surfaces of the conveyor belts.

In another embodiment of the present invention, the tension adjusting means includes a rotatable tension roller rotating in contact with a back of a return run of each of the conveyor belts, and pressurizing bearings for urging the tension roller downwardly.

Preferably, the gathering means is removably mounted above the return runs of the conveyor belts just under the radiant heating means.

In the other embodiment of the present invention, the gathering means comprises a receiving tray or saucer extending through a whole width of the conveyor belt means.

Preferably, each of the conveyor belts has a white color.

DETAILED DESCRIPTION OF THE PREFERRED EMBODIMENTS

Figure 2:
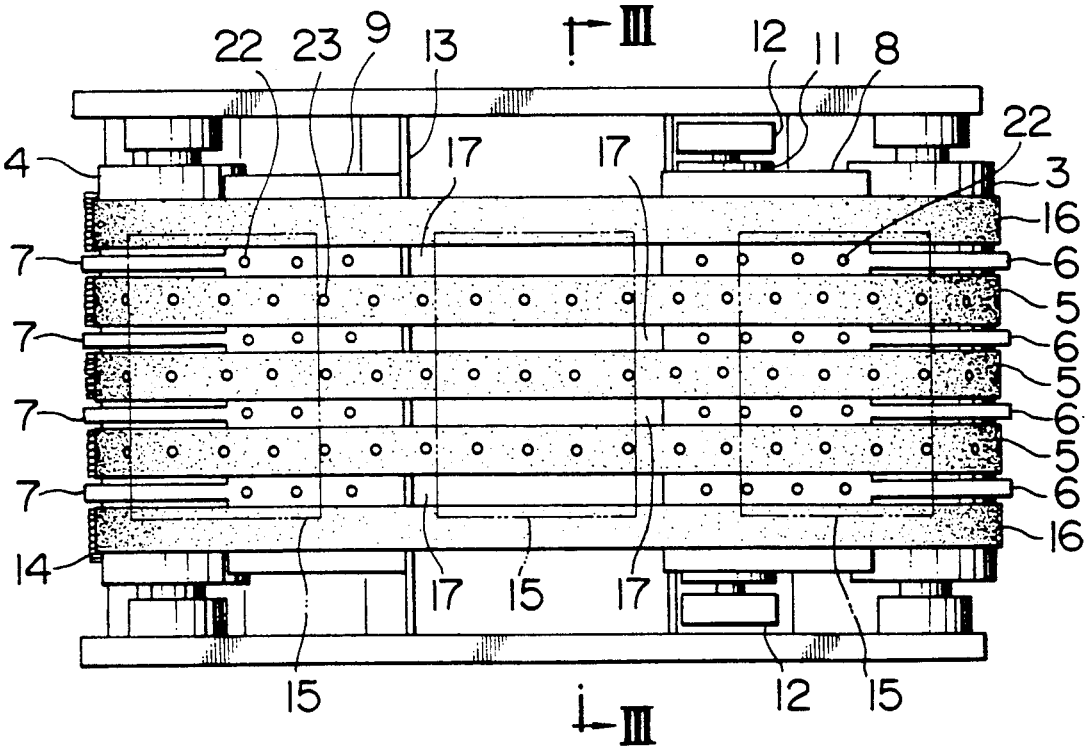
FIG. 2 is a plan view of the fixing apparatus of FIG. 1 with removing a lamp house to show the internal construction thereof.
Figure 3:
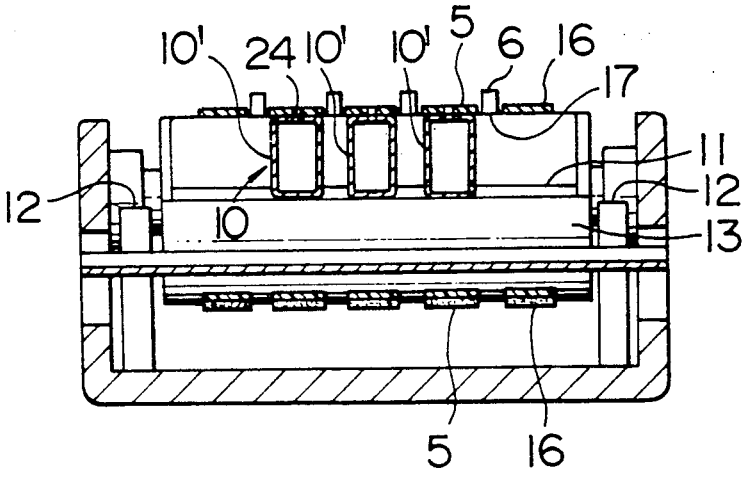
FIG. 3 is a sectional view taken along the line III—III of FIG. 2.

A radiant heat fixing apparatus according to the present invention will now be explained with reference to FIGS. 1 to 3.

In a preferred embodiment of the present invention, a recording paper 15 having a predetermined size is used as a recording medium. Paper guides 6 and 7 are arranged at an inlet portion and an outlet portion of the fixing apparatus, respectively.

A radiant heating device 19 is arranged above a conveyor belt system 18 which transports or conveys the recording paper 15 on which toner images are developed by electrostatic force. The radiant heating device 19 comprises a lamp house 2, a downwardly directed reflector 21 arranged in the lamp house 2, a xenon flash lamp 1 arranged inside of the reflector 21, and a lens 20 covering the reflector 21. The conveyor belt system 18 includes a driving roller 4 rotatably driven by means of an appropriate driving means (not shown), a driven roller 3 rotatably mounted on a frame of the apparatus, and a plurality of conveyor belts extending between the driving and driven rollers 4 and 3 in parallel with the lens 20 of the radiant heating device 19. The plurality of conveyor belts comprises two non-perforated conveyor belts 16 and three porous or perforated conveyor belts 5 situated between the non-perforated conveyor belts. There is a clearance 17 between the two adjacent conveyor belts. Each of the conveyor belts 5, 16 has a bright color such as white, yellow, blue and the like having small absorptivity of light.

Suction chambers 8 and 9 are provided between transporting runs i.e., upper runs of the conveyor belts 5, 16 and return run i.e., lower runs of the conveyor belts, these suction chambers 8, 9 being, connected to a suction pump (not shown) to create negative pressure (with respect to atmosphere) therein during the operation of the fixing apparatus. The suction chambers 8 and 9 are positioned at inlet and outlet sides of the conveyor belt system, respectively, and each has a plurality of through holes 22 at positions faced to the clearances 17 between the belts. A suction chamber 10 positioned between the suction chambers 8 and 9 comprises a plurality of chambers 10' and arranged in an area A that is directly illuminated by a flash from the radiant heating device 19. Each chamber 10' is completely covered by the above three perforated conveyor belts 5 and has a longitudinal slit 24 on its surface facing to holes 23 of the perforated conveyor belts 5. The slit 24 extends in a direction to which the corresponding perforated conveyor belt 5 is moved.

Below the suction chamber 10, a receiving tray or saucer 13 is removably mounted just above and in the proximity of the lower or return runs of the conveyor belts. The saucer 13 extends through the whole width of the conveyor belt system 18.

Adjacent to the driving roller 4 positioned at the outlet portion of the fixing apparatus, a brush roller 14 which can be rotated in the direction of movement of the conveyor belts is arranged in contact with the driving roller 4.

A tension adjusting device 25 is arranged below the suction chamber 8 outside of the area A that is directly illuminated by the flash from the radiant heating device 19. The tension adjusting device 25 comprises a rotatable tension roller 11 which is rotated in contact with the backs of the return runs of the conveyor belts 5 and 16, and pressurizing bearings 12 for urging the tension roller 11 downwardly. For example, the pressurizing bearing 12 may be constructed to include therein a spring for urging a rotating shaft of the tension roller 11 downwardly. With this construction, the tension roller 11 always applies a tension force to the conveyor belts 5 and 16.

Next, the operation of the fixing apparatus will be explained.

Figure 1:
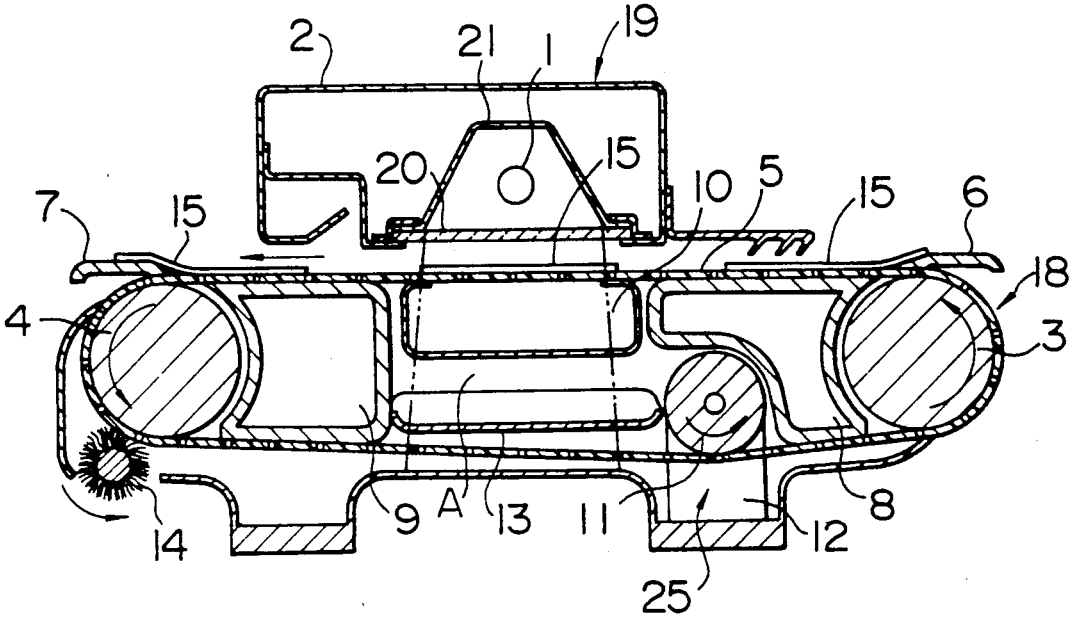
FIG. 1 is a sectional elevational view of a radiant heat fixing apparatus according to a preferred embodiment of the invention.

When the driving roller 4 is rotated in a direction shown by an arrow by means of the driving means (not shown), the perforated conveyor belts 5 and the non-perforated conveyor belts 16 are also rotated or shifted in a direction shown by an arrow in FIG. 1. When the recording paper 15 on which the toner images have been developed is supplied from a developing means (not shown) onto the paper guide 6, by the movement of the conveyor belts 5 and 16, the recording paper 15 is passed through under the radiant heating device 19 and then is sent to another apparatus positioned outside of the fixing apparatus through the outlet paper guide 7. Meanwhile, when the recording paper 15 reaches a position just under the xenon flash lamp 1, the xenon flash lamp 1 is energized to emit the flash; the flash is illuminated onto the surface of the recording paper 15, whereby the toner images formed on the recording paper 15 are fixed onto the recording paper 15. During movement of the recording paper in the fixing apparatus, the recording paper 15 is transported such that it is closely engaged by the conveyor belts 5 and 16 by the action of the suction chambers 8, 9 and 10. In order to provide suction force for the recording paper 15, the air is sucked, on one hand, through the holes 22 into the suction chambers 8 and 9 and, on the other hand, through the holes 23 of the perforated conveyor belts 5 and the slits 24 into the suction chamber 10.

While the recording paper 15 is transported, paper powder will be dropped out from the paper. If such paper powder is accumulated in an area where the temperature is remarkably increased by the direct illumination of the flash from the radiant heating device 19, i.e., in a zone of the upper runs of the conveyor belts just below the radiant heating device, the paper powder will be fired by only a few flash illumination operations. Further, if such paper powder drops through the clearances or gaps 17 between the conveyor belts onto the backs of the return runs of the perforated and non-perforated conveyor belts 5 and 16, the paper powder sticks or adheres thereon, thus causing the relative slipping movement between the conveyor belts 5, 16 and the rollers 3, 4, resulting in imperfect transportation of the recording paper 15.

In view of the above, in the embodiment of the present invention, since the suction chamber 10 positioned in the area A that is directly illuminated by the flash from the radiant heating device 19 comprises a plurality of chambers 10' and each chamber 10' is completely covered by the corresponding perforated conveyor belt 5, the paper powder is not accumulated on the suction chambers 10'. Therefore, the firing of the paper powder is effectively prevented. Further, since there is provided the saucer 13 extending through the whole width of the conveyor belt system 18 below the suction chamber 10, the paper powder dropped through the gaps 17 is accumulated or gathered into the saucer 13. As shown in FIG. 1, since the saucer 13 is positioned in the proximity of the return runs of the conveyor belts, the paper powder gathered in the saucer 13 is not subjected to the strong flash, thus preventing the firing of the paper powder. Further, with such construction, since the paper powder is gathered above the return runs of the conveyor belts 5, 16 (into the saucer), the paper powder is not adhered on the backs of the return runs of the belts at all, thus effectively preventing the imperfect transportation of the recording paper due to the relative slipping movement between the belts and the rollers.

As explained above, the temperature of the upper runs of the conveyor belts will be increased by the repeated flash illuminating operations; however, in the embodiment of the present invention, since each of the conveyor belts 5 and 16 has a bright color such as white, yellow, blue and the like having small absorptivity of light, the temperature of the conveyor belts 5 and 16 is not increased up to the firing temperature of the recording paper 15, thus preventing the firing of the recording paper.

Further, the conveyor belts 5 and 16 will be expanded or elongated by the thermal expansion thereof; however, in the embodiment of the present invention, since the tension adjusting device 25 is provided for adjusting the tension of the conveyor belts 5, 16 there is no slack in these conveyor belts. Consequently, it is possible to prevent the imperfect transportation of the recording paper derived from the relative movement between the conveyor belts 5, 16 and the rollers 3, 4 and to prevent the imperfect fixing of the toner on the recording paper due to the change of the illuminating angle of the flash regarding the recording paper.

If the tension adjusting device 25 is installed below the suction chamber 10, i.e., in the area A that is directly illuminated by the flash emitted from the radiant heating device 19, the paper powder from the recording paper 15 will dropped through the gaps between the chambers 10' and will adhere on the tension roller 11 and then will be transferred from the tension roller to the backs of the return runs of the conveyor belts 5, 16, thus causing the relative slipping movement between the conveyor belts 5, 16 and the rollers 3, 4. However, in the embodiment of the present invention, since the tension adjusting device 25 is arranged below the suction chamber 8, i.e., outside of the area A that is directly illuminated by the flash emitted from the radiant heating device 19, such inconvenience can be eliminated effectively.

Further, when the fixing operation is effected by means of the xenon flash lamp 1, the toner heated by the flash illumination emits or generates gas. Such gas will adhere on the surfaces of the conveyor belts 5 and 16 and will be solidified thereon, thus smearing the conveyor belts. Also, as stated above, the paper powder will be accumulated on the surfaces of the conveyor belts 5, 16. If the fixing operation is repeated without removing such solidified gas and the paper powder from the conveyor belts, the back of the recording medium 15 will be smeared by the solidified gas and the paper powder accumulated on the conveyor belts will be fired in operation of the apparatus. However, in the embodiment of the present invention, since the brush roller 14 is rotatably arranged in contact with the driving roller 4 and the smear and paper powder on the conveyor belts are removed just after they are accumulated thereon, such inconvenience due to the solidified gas and paper powder can be eliminated.

What is claimed is:

1. A fixing apparatus comprising:

conveyor belt means for conveying a recording medium on which toner images are developed, having two non-perforated conveyor belts and a plurality of perforated conveyor belts arranged between said two non-perforated conveyor belts;

radiant heating means arranged above said conveyor belt means, for heating said recording medium situated on said conveyor belt means by a flash and for fusing and fixing the toner images on said recording medium;

suction means arranged in an area that is directly illuminated by the flash from said radiant heating means, below said plurality of perforated conveyor belts, so as to be completely covered by said plurality of perforated conveyor belts:

cleaning means arranged outside of said area that is directly illuminated by the flash from said radiant heating means, for eliminating foreign matter on outer surfaces of said plurality of perforated conveyor belts; and gathering means arranged inside of said area that is directly illuminated by the flash from said radiant heating means, below said suction means, for gathering the foreign matter dropped from said recording medium;

said gathering means being removably mounted above return runs of said conveyor belts just under said radiant heating means.

2. A fixing apparatus comprising:

conveyor belt means for conveying a recording medium on which toner images are developed, having two non-perforated conveyor belts and a plurality of perforated conveyor belts arranged between said two non-perforated conveyor belts;

radiant heating means arranged above said conveyor belt means, for heating said recording medium situated on said conveyor belt means by a flash and for fusing and fixing the toner images on said recording medium;

suction means arranged in an area that is directly illuminated by the flash from said radiant heating means, below said plurality of perforated conveyor belts, so as to be completely conveyed by said plurality of perforated conveyor belts;

cleaning means arranged outside of said area that is directly illuminated by the flash from said radiant heating means, for eliminating foreign matter on outer surfaces of said plurality of perforated conveyor belts; and gathering means arranged inside of said area that is directly illuminated by the flash from said radiant heating means, below said suction means, for gathering the foreign matter dropped from said recording medium said gathering means comprising a saucer through a whole width of said conveyor belt means.

3. A fixing apparatus comprising:

conveyor belt means for conveying a recording medium on which toner images are developed, having two non-perforated conveyor belts and a plurality of perforated conveyor belts arranged between said two non-perforated conveyor belts;

radiant heating means arranged above said conveyor belt means, for heating said recording medium situated on said conveyor belt means by a flash and for fusing and fixing the toner images on said recording medium;

suction means arranged in an area that is directly illuminated by the flash from said radiant heating means, below said plurality of perforated conveyor belts, so as to be completely covered by said plurality of perforated conveyor belts;

cleaning means arranged outside of said area that is directly illuminated by the flash from said radiant heating means, for eliminating foreign matter on outer surfaces of said plurality of perforated conveyor belts;

tension adjusting means arranged outside of said area that is directly illuminated by the flash from said radiant heating means, for adjusting a tension force of each of said conveyor belts;

gathering means arranged inside of said area that is directly illuminated by the flash from said radiant heating means, below said suction means, for gathering the foreign matters dropped from said recording medium; and said plurality of perforated conveyor belts each having a bright color.

4. A fixing apparatus as set forth in claim 3, wherein said gathering means is removably mounted above return runs of said conveyor belts just under said radiant heating means.

5. A fixing means as set forth in claim 4, wherein said gathering means comprises a saucer extending through a whole width of said conveyor belt means.

6. A fixing apparatus as set forth in claim 3, wherein each of said conveyor belts has a white color.

7. A fixing apparatus comprising:

conveyor belt means for conveying a recording medium on which toner images are developed, having two non-perforated conveyor belts and a plurality of perforated conveyor belts arranged between said two non-perforated conveyor belts;

radiant heating means arranged above said conveyor belt means, for heating said recording medium situated on said conveyor belt means by a flash and for fusing and fixing the toner images on said recording medium;

suction means arranged in an area that is directly illuminated by the flash from said radiant heating means, below said plurality of perforated conveyor belts, so as to be completely conveyed by said plurality of perforated conveyor belts;

cleaning means arranged outside of said area that is directly illuminated by the flash from said radiant heating means, for eliminating foreign matter on outer surface of said plurality of perforated conveyor belts;

further comprising gathering means arranged inside of said area that is directly illuminated by the flash from said radiant heating means, below said suction means, for gathering foreign matters dropped from said recording medium.

8. A fixing apparatus comprising:

conveyor belt means for conveying a recording medium on which toner images are developed, having two non-perforated conveyor belts and a plurality of perforated conveyor belts arranged between said two non-perforated conveyor belts;

radiant heating means arranged above said conveyor belt means, or heating said recording medium situated on said conveyor belt means by a flash and for fusing and fixing the toner images on said recording medium;

suction means arranged in an area that is directly illuminated by the flash from said radiant heating means, below said plurality of perforated conveyor belts, so as to be completely covered by said plurality of perforated conveyor belts; and gathering means arranged inside of said area that is directly illuminated by the flash from said radiant heating means, below said suction means, for gathering foreign matters dropped from said recording medium.

9. A fixing apparatus comprising:

conveyor belt means for conveying a recording medium on which toner images are developed, having two non-perforated conveyor belts and a plurality of non-perforated conveyor belts arranged between said two non-perforated conveyor belts;

radiant heating means arranged above said conveyor belt means, for heating said recording medium situated on said conveyor belt means by a flash and for fusing and fixing the toner images on said recording medium;

suction means arranged in an area that is directly illuminated by the flash from said radiant heating means, below said plurality of perforated conveyor belts, so as to be completely covered by said plurality of perforated conveyor belts;

tension adjusting means arranged outside of said area that is directly illuminated by the flash from said radiant heating means, for adjusting a tension force of each of said conveyor belt;

* * * * *